United States Patent [19]

LaGrange et al.

[11] Patent Number: 4,684,331

[45] Date of Patent: Aug. 4, 1987

[54] VANED SLINGER FOR PUMPS

[75] Inventors: Nyle D. LaGrange; Darryl M. Nielsen, both of Lenexa; Charles F. Wheeler, Olathe, all of Kans.

[73] Assignee: The Marley-Wylain Company, Mission Woods, Kans.

[21] Appl. No.: 778,447

[22] Filed: Sep. 19, 1985

[51] Int. Cl.[4] ..... F04B 47/06

[52] U.S. Cl. ..... 417/366; 417/430; 166/105.5

[58] Field of Search ..... 417/430, 366, 423 R; 166/105.5

[56] References Cited

U.S. PATENT DOCUMENTS

| | | | |
|---|---|---|---|
| 2,042,575 | 6/1936 | Worth | 417/366 |
| 2,285,169 | 6/1942 | Pyle | 417/430 |
| 4,330,306 | 5/1982 | Salant | 166/105.5 |

FOREIGN PATENT DOCUMENTS

| | | | |
|---|---|---|---|
| 1121044 | 6/1956 | France | 417/366 |
| 954621 | 9/1982 | U.S.S.R. | 417/366 |
| 954623 | 9/1982 | U.S.S.R. | 417/366 |

*Primary Examiner*—Carlton R. Croyle
*Assistant Examiner*—Theodore Olds
*Attorney, Agent, or Firm*—Schmidt, Johnson, Hovey & Williams

[57] ABSTRACT

A slinger for a submersible electric pump protects a motor shaft bearing as well as a shaft seal. The slinger is provided with four, inclined, curved projections or vanes which are operable to propel sand or other potentially abrasive, grit-like contaminants away from an area adjacent the shaft seal. A pair of outlet slots disposed horizontally adjacent a lowermost portion of the slinger cooperates with the vanes to enable passage of the contaminants to an area external of the pump, such that the contaminants do not accumulate within the pump itself and the likelihood that the contaminants will enter the first pump stage is significantly reduced. Each of the vanes has a face inclined slightly relative to the frustoconical outer surface of the slinger, and each face terminates in a curved leading edge and a curved trailing edge. The vanes direct the contaminants toward the lowermost portion of the slinger where maximum outward thrust is developed.

7 Claims, 4 Drawing Figures

VANED SLINGER FOR PUMPS

BACKGROUND OF THE INVENTION

1. Field of the Invention

This invention relates to a slinger that is secured to the upper end of a submersible motor shaft adjacent a motor bearing. The slinger is operable to propel sand and other particulate contaminants away from the bearing and toward a cooperating outlet communicating with areas external of the motor.

2. Description of the Prior Art

Deep well submersible pumps must operate reliably for extended periods within a somewhat hostile environment. Oftentimes, wells are drilled into subsurface layers of the earth having a large percentage of sand or other potentially mobile, grit-like contaminants that are transported toward the pump during operation of the latter. However, the use of a filter having effective openings small enough to prevent entry of relatively small particulate material into the pump is generally considered unsatisfactory, due to the difficulty of lifting the pump assembly out of the well for periodic filter replacement. Consequently, it has become common practice to allow such contaminants to enter the pump along with the water so that a filter downstream of the pump and ahead of the point of use can be disposed at a more convenient and accessible location.

As a result, it is desirable to construct submersible pumps to withstand any adverse effects of the flow of sand and other abrasive, grit-like contaminants through the pump assembly. Sand, for example, can quickly damage a relatively soft sleeve bearing supporting the motor armature to the point where the useful life of the motor is significantly reduced. However, the use of an ordinary shaft seal surrounding the shaft and connected to a motor end member cannot, by itself, effectively preclude entry of such contaminants into the area adjacent the bearing.

In the past, certain submersible pumps have been provided with a rubber body or slinger which surrounds the motor shaft above the shaft bearing and shaft seal. The slinger is typically positioned within a lowermost portion of a chamber defined by structure interconnecting the motor and pump stages, wherein the structure has an inlet opening for enabling passage of water from the well, into the chamber and toward the first or lowermost impeller. Known prior art slingers typically have a cylindrical, conical, or convex outer surface which is generally smooth, so that during rotation of the shaft, the outer surface of the slinger agitates the water in the adjacent areas in an effort to prevent sediment in the water from settling toward the underlying seal and bearing.

Unfortunately, operation of such slingers over the years has proved to be somewhat unsuccessful in effectively directing the contaminants away from the bearing. Although the smooth rotating surface of these slingers agitates the surrounding water, denser particles are often unaffected by the agitation and instead settle toward the bottom of the chamber. In these instances, the slingers often function in a manner similar to an umbrella and merely shield the bearing from the settling contaminants.

Moreover, the chambers of prior art pumps often are provided with an inlet spaced some distance above the slinger, so that the slinger is located in a relatively "dead" area away from the flow of water between the well and the first pump stage. As a result, some particles remain in the lowermost portion of the chamber unless flushed out by water draining back in reverse direction through the pump when operation of the latter is interrupted. In wells with relatively large amounts of particulate contaminants, buildup of the contaminants can occur in a relatively short period of time to the point where the pump is literally "choked" and unable to run.

SUMMARY OF THE INVENTION

The present invention overcomes the disadvantages of the prior art by provision of a novel slinger which is operable to eject sand and other grit-like particulates toward an area external of the pump. During each cycle of operation of the pump, the particulates are continuously propelled away from the area surrounding the shaft bearing and are generally unable to accumulate in the chamber. Futhermore, the contaminants are directed away from the pump stages so that the quality of pumped water at the point of use is substantially improved.

In more detail, the slinger includes four spaced projections or vanes which extend outwardly from a generally frustoconical surface of a rubber body. Each of the projections has a face that is slightly inclined relative to the frustoconical surface, such that rotation of the slinger enables the inclined faces to directly engage particulates in the water and propel the same away from the bearing. The configuration of the inclined faces of the vanes, in combination with the frustoconical shape of the body, cooperate to urge the particulates downwardly along the body until the latter are finally propelled outwardly with a maximum of thrust at a larger diameter, lowermost portion of the slinger.

An outlet on the pump is provided for enabling passage of contaminant material propelled by the slinger from the chamber and toward an area external of the pump. The outlet advantageously can take the form of pair of elongated slots spaced from the chamber inlet and lying in a plane extending transversely through the pump shaft and the sand-ejecting, lowermost portion of the slinger. As particulates are expelled through the slots and enter the well, the particulates descend toward an area of the well underlying the motor and, due to their density, do not generally become re-entrained with the flow of fluid entering the pump inlet.

DETAILED DESCRIPTION OF THE DRAWINGS

Figure 1:
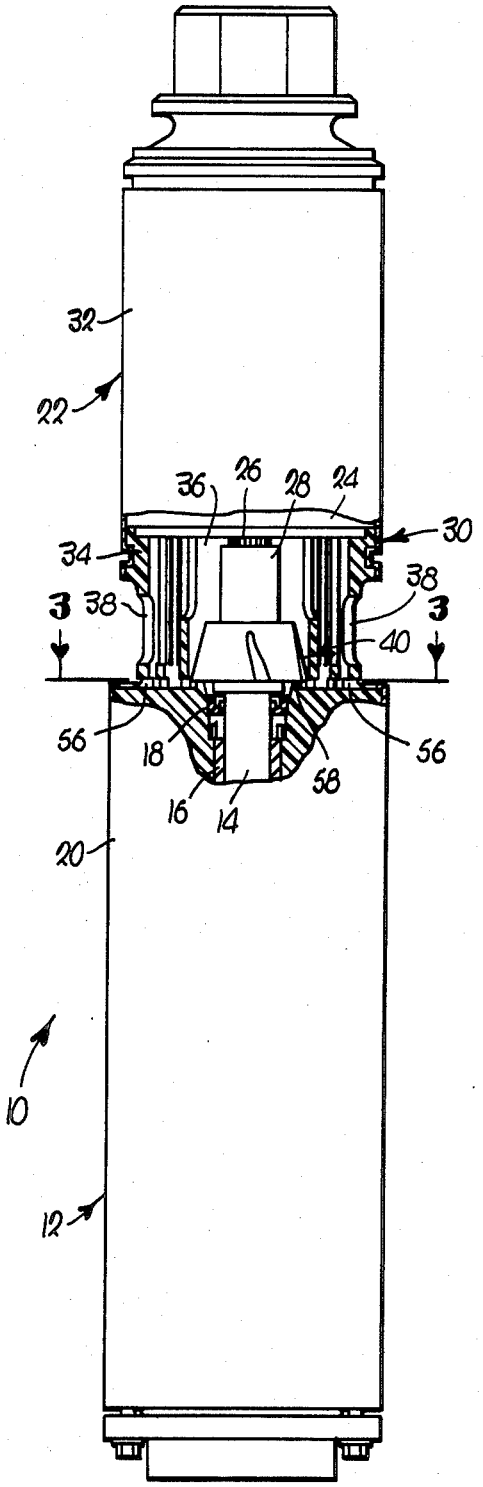
FIG. 1 is a side view, partially in elevation and partially in cross-section, showing the slinger and the adjacent outlets of the instant invention.

Referring initially to FIG. 1, a submersible, deep well pump assembly is designated broadly by the numeral 10 and includes a motor 12 having shaft means shaft 14 rotatably supported by a sleeve bearing 16. A ring-like, transversely U-shaped seal 18 surrounds the shaft 14 above the bearing 16, and a thin, cylindrical shell 20 surroundingly encases the motor 12.

The pump assembly 10 also includes a pump unit or pump 22 having a plurality of stages 24, although only a portion of the first or lowermost stage is shown in FIG. 1. Each stage 24 includes an impeller means fixedly interconnected to a pump drive shaft 26 which is connected to the motor shaft 20 by a coupling 28.

A structure interconnecting the motor 12 and the pump 22 comprises a coupling base 30 which is secured at an upper end portion to a pump casing 32 surrounding the stages 24, and also is affixed at a lower end portion to the motor shell 20. The base 30, advantageously molded of a synthetic resinous material, has integral walls 34 which define a chamber 36 surrounding the motor shaft 14 as well as the pump drive shaft 26. The chamber 36 is in communication with an inlet orifice (not shown) for the impeller of the lowermost stage 24. The base 30 also includes a pair of radially opposed inlet openings or inlets 38, 38 communicating with the chamber 36 for admission of water to the chamber 36 from an area external of the pump assembly 10, such as a deep well or other water containing means.

Figure 2:
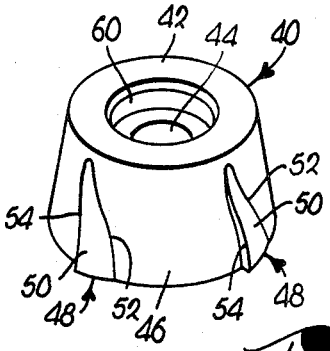
FIG. 2 is an enlarged, perspective view of the vaned slinger as shown in FIG. 1.

A means associated with the motor shaft 14 for directing solid contaminant matter such as sand or other grit-like particles away from the bearing 16 comprises a slinger 40 disposed immediately above the seal 18. Referring to FIG. 2, the slinger 40 is comprised of a molded, synthetic rubber body 42 having an axial bore 44 of a diameter for complemental, securing reception of the shaft 14. Viewing FIG. 1, the slinger 40 is positioned within the chamber 36 intermediate the coupling 28 and the motor seal 18.

As illustrated in FIGS. 1–2, the body 42 has a generally frustoconical outer surface 46 disposed in upright relation to the assembly 10. The body 42 also includes four projections or vanes 48 that are equally spaced circumferentially about the surface 46 and extend outwardly in relation to the shaft 14. Preferably, the vanes 48 are integrally molded with the body 42 and have an outer face 50 that is inclined relative to the surface 46. The faces 50 are configured to present a curved, somewhat S-shaped leading edge 52 planar with the surface 46, and also a curved, somewhat S-shaped trailing edge 54 spaced from the surface 46.

Viewing FIG. 1, the lowermost portion of the slinger 40 disposed in the chamber 36 is positioned horizontally adjacent an outlet means comprising a pair of slots 56, 56 in the base 30. The slots 56, 56 are radially opposed from each other and communicate the chamber 36 to an area external of the assembly 10. As shown, the lowermost edge of the frustoconical surface 46 on the body 42 is disposed immediately adjacent the center of each of the slots 56, 56. Also, the slots 56, 56 are spaced from the inlets 38, 38.

Finally, a bottom portion of the slinger 40 has a circular groove (not shown) for reception of an upwardly extending, mating lip 58 on the base 30. Additionally, the body 42 has an upper, circular recess 60 (see FIG. 2) for complementally receiving a lower end portion of the coupling 28.

In use, as the motor 12 is activated, the shafts 14, 24 rotate the impellers of the stages 24 such that water is drawn through the inlets 38, 38, into the chamber 36 and toward the lowermost stage 24. At the same time, the slinger 40, being secured to the shaft 14, rotates within a lower portion of the chamber 36.

The vanes 48 on the slinger 40 are operable to direct contaminant matter away from the bearing 16 as well as the seal 18 and toward the slots 56, 56 as the shaft 14 is rotated. The slots 56, 56 thus enable passage of the contaminants from the chamber 36 to an area external of the pump 10.

Figure 3:
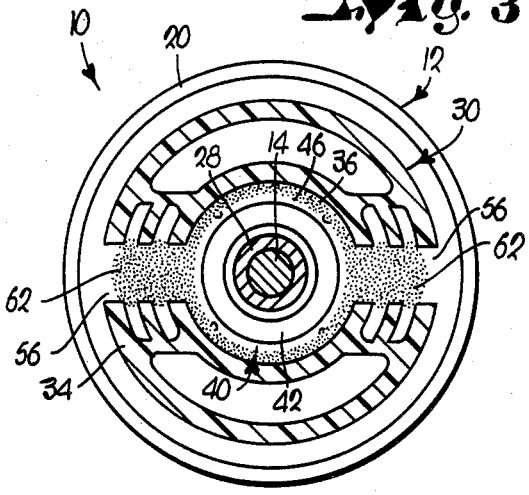
FIG. 3 is an enlarged, offset sectional view taken substantially along line 3—3 of FIG. 1 but showing the slinger in plan view and also depicting the location of sand or other particulate matter settling within a chamber of the pump as operation of the latter is interrupted.

FIG. 3 is an illustration of a hypothetical condition when the motor 12 is inactivated. Water within the chamber 36 can contain sand, scale, dirt or other grit-like, particulate contaminants 62 which could damage the relatively soft motor bearing 16 as well as the seal 18 during subsequent rotation of the shaft 14. As is shown, the effects of gravity enable the contaminants 62 to settle toward the lowermost portions of the chamber 36 as well as the slots 56, 56.

Figure 4:
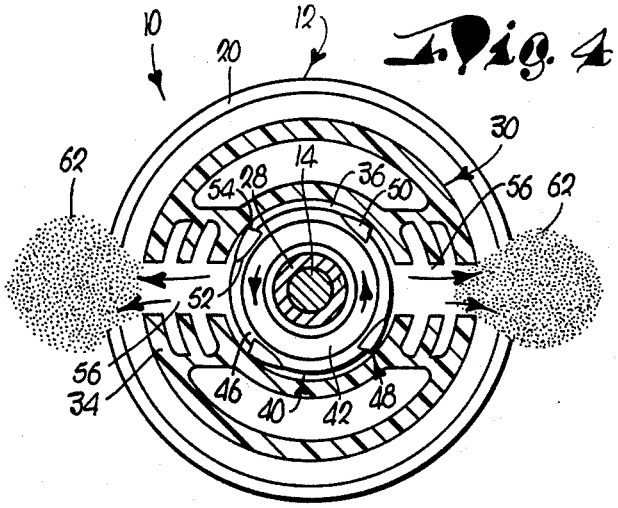
FIG. 4 is a view similar to FIG. 3, showing the movement of the particulate matter through the outlet slots as the pump is activated and the slinger is thereby rotated.

During operation of the pump 10, rotation of the slinger 40 directs the contaminants 62 away from the bearing 16 and the seal 18 and toward the slots 56, 56 as is depicted in FIG. 4. It is believed that the curved edges 52, 54 tend to urge the contaminants 62 downwardly toward a lower portion of the slinger 40, at which portion is developed the maximum amount of thrust during rotation of the slinger 40. After the contaminants 62 move downwardly toward the lowermost edge of the surface 46, the vanes 48 propel the contaminants 62 horizontally through the slots 56, 56. The relatively slight incline of the face 50 of each of the vanes 48 reduces frictional forces which would otherwise tend to reduce the speed and efficiency of the motor 12.

Thus, it should now be obvious to those skilled in the art that the use of the slinger 40 in cooperation with the outlet slots 56, 56 constitutes an advance in the art of pump construction. The "dead" chamber area of prior art pumps often traps particles unless the same are sufficiently agitated to be directed toward the first impeller stage by the incoming flow of water. However, in the instant invention, provision of the vanes 48 in cooperation with the slots 56, 56 enables the contaminants 62 to be directed immediately to the exterior of the pump 10, thus not only protecting the bearing 16 and the seal 18 but also reducing the likelihood that such contaminants 62 will enter the first stage 24, and thereby improving the quality of the pumped water at the point of use.

We claim:

1. In combination:

pump unit having a casing and at least one pump stage;

structure connected to said pump unit casing having walls defining a chamber adjacent said pump stage, said chamber defining walls of said structure having an inlet opening for admitting fluid to said chamber;

an electric motor connected to said structure having rotatable output shaft means extending through said chamber and operably coupled to said pump stage for pumping of fluid from said chamber and in a direction generally along said shaft means toward said stage; and a slinger mounted to said shaft means and disposed in said chamber for directing solid contaminants away from said pump unit and said motor, said slinger including a projection extending radially outwardly in relation to the rotational axis of said shaft means, said chamber defining walls of said structure having a fluid outlet spaced from said fluid inlet and communicating said chamber with areas external of said structure, said fluid outlet lying substantially in a reference plane perpendicular to the rotational axis of said shaft means and generally extending through said projection of said slinger for enabling direct discharge of solid contaminants in directions substantially radially of said shaft means and thereby in directions generally transverse to the flow of fluids in said chamber toward said pump stage, for facilitating separation of solid contaminants from liquids to be pumped, said fluid outlet lying beneath said inlet opening.

2. The invention of claim 1, said slinger having a generally frustoconical surface.

3. The invention of claim 2, said projection including a face inclined relative to said surface of said slinger.

4. The invention of claim 3, said projection face presenting a curved leading edge planar with said surface.

5. The invention of claim 3, said projection face presenting a curved trailing edge spaced from said surface.

6. The invention of claim 1, said slinger being comprised of a synthetic rubberlike material, said projections being integrally molded with said body.

7. The invention of claim 1, said outlet comprising a slot having a longitudinal axis lying in a plane transverse to said shaft means.

* * * * *